US006616589B1

(12) United States Patent
Maehans

(10) Patent No.: US 6,616,589 B1
(45) Date of Patent: Sep. 9, 2003

(54) METHOD AND EQUIPMENT FOR CONTROLLING THE POSITION OF AN INTERFACE BETWEEN SEPARATED LIQUIDS IN A CENTRIFUGAL ROTOR

(75) Inventor: Olev Maehans, Sodertalje (SE)

(73) Assignee: Alfa Laval AB, Tumba (SE)

( * ) Notice: Subject to any disclaimer, the term of this patent is extended or adjusted under 35 U.S.C. 154(b) by 0 days.

(21) Appl. No.: 09/622,498

(22) PCT Filed: Nov. 10, 1999

(86) PCT No.: PCT/SE99/02037

§ 371 (c)(1),
(2), (4) Date: Oct. 23, 2000

(87) PCT Pub. No.: WO00/37177

PCT Pub. Date: Jun. 29, 2000

(30) Foreign Application Priority Data

Dec. 21, 1998 (SE) ..... 9804451

(51) Int. Cl.[7] ..... B04B 11/00
(52) U.S. Cl. ..... 494/37
(58) Field of Search ..... 494/1–6, 10, 11, 494/23, 27–30, 37, 56, 68–70; 210/209, 210

(56) References Cited

U.S. PATENT DOCUMENTS 1,866,638 A 7/1932 Fawcett
3,273,790 A * 9/1966 Dahlberg
4,005,817 A * 2/1977 Charlton et al.
4,305,817 A * 12/1981 Kohlstette
4,343,431 A * 8/1982 Wehling
4,525,155 A * 6/1985 Nilsson, deceased
4,755,165 A 7/1988 Gunnewig
4,840,612 A * 6/1989 Pallmar
5,944,649 A * 8/1999 Karlsson

FOREIGN PATENT DOCUMENTS

SE 501246 12/1994

* cited by examiner

*Primary Examiner*—Charles E. Cooley
(74) *Attorney, Agent, or Firm*—McCormick, Paulding & Huber LLP

(57) ABSTRACT

The invention disclosed is control equipment for use with a nozzle centrifuge for separating a light phase liquid, a heavy phase liquid, and/or solids from a mixture thereof wherein the separated heavy phase and solids are continuously removed through nozzles that are arranged at the periphery of the rotor of the nozzle centrifuge. Separated light phase liquid is discharged through a central outlet in the rotor. Through a space in the rotor, which communicates with the radially outer part of the rotor separating chamber, liquid may either be supplied under pressure to the rotor or be discharged from the rotor for maintaining an interface layer formed in the separating chamber between separated light and heavy phases. A supply device and a discharge device are adapted to supply to the rotor and discharge from the rotor, respectively, only so much liquid as is required for said purpose. The discharge device is separated from the supply device, so that discharged liquid need not be subjected to the pressure generated by or maintained in the supply device.

10 Claims, 4 Drawing Sheets

METHOD AND EQUIPMENT FOR CONTROLLING THE POSITION OF AN INTERFACE BETWEEN SEPARATED LIQUIDS IN A CENTRIFUGAL ROTOR

FIELD OF THE INVENTION

The present invention relates to control equipment for a centrifugal separator for separating a light liquid having a relatively low density and a heavy liquid having a relatively high density from a mixture containing these two liquids. The liquids may, for instance, be constituted by oil and water. The control equipment is intended for a centrifugal separator comprising a rotor, which is rotatable around a rotational axis and forms an inlet for said mixture and a separating chamber, which communicates with the inlet and which has a radially inner part and a radially outer part, said parts being adapted during a separating operation to contain separated light liquid and separated heavy liquid, respectively.

BACKGROUND OF THE INVENTION

A centrifugal separator of this kind may have outlets for the separated liquids formed in several different ways. Thus, the rotor may be provided with so-called overflow outlets for both of the liquids or an overflow outlet for one liquid and another kind of outlet for the other liquid. An outlet of such another kind may be constituted, for instance, by a non-rotatable so-called paring member or by nozzles situated in the surrounding wall of the rotor. Nozzles are used as a rule when the supplied mixture in addition to said two liquids also contains solids which are heavier than the two liquids. Then, separated solids together with part of the heavy liquid may be discharged through nozzles placed at the periphery of the rotor, whereas the separated light liquid is discharged from a central part of the rotor through an overflow outlet or a paring member. In these cases the rotor can also form a space, which communicates with the radially outer part of the separation chamber in a way such that during a separating operation it will contain separated heavy liquid but not separated light liquid. An excess of separated heavy liquid, which does not leave the separation chamber through said nozzles, is then discharged from the rotor through this space.

Another type of centrifugal separator, in which solids as well as two different liquids may be separated, is a so-called decanter centrifuge. In a centrifugal separator of this kind there is arranged within the rotor a so-called sludge conveyor, which is adapted to transport to a sludge outlet separated solids along the surrounding wall of the rotor. The sludge outlet is often situated at a level in the rotor radially inside the level of the outlets for the two separated liquids.

In a nozzle centrifuge of the above described kind as well as in a decanter centrifuge having a sludge conveyor it may be difficult during a separating operation always to maintain an interface layer, which is formed in the rotor between the liquids separated therein, at a predetermined radial level. The reason for this is that an uncontrollable amount of separated heavy liquid per unit of time leaves together with the separated solids through the so-called sludge outlet of the rotor. If this uncontrollable amount of heavy liquid would exceed the amount of heavy liquid, which per unit of time is introduced into the rotor together with the mixture to be treated therein, the interface layer in the separating chamber between light liquid and heavy liquid will move radially outwardly, and finally separated light liquid will be lost together with the separated solids, when these leave the rotor through the sludge outlet.

A particular separating operation, in which this has caused a problem, is cleaning of oil from sand and water in connection with recovery of oil from so-called oil sands. In this connection nozzle centrifuges are used in at least two separating steps.

In a first separating step a mixture of oil, water, solvent and sand residues is introduced into a nozzle centrifuge, and in addition to the mixture a large amount of water is supplied to the centrifuge. The sand and the main part of the supplied water leave the centrifuge rotor through its nozzles, whereas part of the water is removed from the rotor through a central overflow outlet. Separated oil and solvent are conducted out of the rotor from a central part thereof through a paring member and are pumped further to another nozzle centrifuge to go through a second separating step. Said water being added separately in the first separation step is added in excess, so that the interface layer formed in the separating chamber of the rotor between oil and water shall not be displaced radially outwardly, even after many hours' operation of the centrifugal separator, when its nozzles have become worn of the outflowing sand and, therefore, let out more water per unit of time than at the beginning of the separating operation.

After the first separating step the oil contains in addition to solvent still residues of sand and water. For obtainment of a separating result as good as possible there has been developed for controlling the separating operation in the second separating step a particular control equipment. By means of this control equipment it is possible to avoid continuous addition of an excess amount of water to the mixture being introduced into the centrifugal rotor. Instead, there is introduced into the separating chamber of the rotor—only when this is needed and only in a required amount—water through a space in the rotor of the kind as previously described, i.e. a space communicating only with the radially outer part of the separating chamber. Through the same space water is also removed from the rotor during periods when an excess of water enters together with the oil to be cleaned, which excess of water cannot leave the rotor through the sludge outlet nozzles.

Said control equipment, which has been developed particularly for the second separating step, is expensive and complicated, however. Thus, it comprises for each one of a great number of nozzle centrifuges a pressure vessel for water. The lower part of the pressure vessel communicates through a conduit with a liquid transferring member, which is situated in said space in the rotor of the centrifugal separator, for the introduction of water into or discharge of water out of the rotor. In the upper part of the pressure vessel there is maintained a gas pressure (usually by means of nitrogen gas), the magnitude of which is continuously controlled in response to the amount of water which at each moment is present in the pressure vessel, so that the liquid pressure at the bottom of the pressure vessel and thus within the conduit, through which the pressure vessel communicates with said space in the centrifugal rotor, is always kept constant at a predetermined value.

The constant value of the liquid pressure in said conduit corresponds to a desired radial level in the separating chamber of the rotor for the interface layer formed therein between separated oil and separated water. If the interface layer moves radially outwardly from the desired level, the pressure drops in said space in the rotor, the result of which is that water is pressed from the pressure vessel through said conduit into the rotor, until the interface layer has returned to the desired radial level. A level-sensing member in the pressure vessel is adapted to initiate upon need the supply of new water to the pressure vessel, so that it will never be empty of water.

If the interface layer in the separating chamber of the rotor starts to move radially inwardly from the desired level, the pressure in said space in the rotor increases, excess of water being pressed from this space through said conduit into the pressure vessel. When the liquid level in the pressure vessel has risen to an upper limit level, a bottom outlet of the pressure vessel is opened for release of water therefrom.

The object of the present invention is to provide a simple and inexpensive control equipment for a centrifugal separator of the initially described kind, in the rotor of which a space of the above discussed kind is delimited.

SUMMARY OF THE INVENTION

This object can be obtained by means of a control equipment including a supply device for supply to the rotor of a control liquid having a density higher than that of said light liquid, said supply device having a pressure source for supplying pressurized control liquid and a supply conduit, which at its one end is connected to the pressure source for receiving pressurized control liquid and at its other end is connected to a liquid transferring member for introducing pressurized control liquid into the rotor, the supply device further being adapted upon need to supply control liquid to the rotor only in an amount per unit of time such that is required for avoiding that an interface layer formed in the separating chamber between separated light liquid on one side and separated heavy liquid or control liquid on the other side moves radially outwardly from a predetermined radial supply level, and a discharge device for discharge of separated heavy liquid and/or control liquid from said space in the rotor, the discharge device having a discharge conduit and being adapted, when the rotor is charged with an excess of heavy liquid, to discharge separated heavy liquid and/or control liquid from the rotor through said discharge conduit in an amount per unit of time such that is required for avoiding that said interface layer moves radially inwardly from a predetermined radial discharge level.

According to the invention a control equipment of this kind is characterized in that the discharge device is arranged to discharge liquid from said space in the rotor a different way than through said supply device.

The control equipment according to the invention distinguishes from the previously described known control equipment principally in that the pressure source for control liquid, which is part of the supply device, is not integrated in the discharge device. The separated heavy liquid and/or control liquid leaving the rotor, thereby, need not be accumulated at an elevated pressure and consequently no pressure vessel is needed. Also, there is no need for a system for compression of gas and for control of the pressure of such a gas. Instead, the pressure source may be constituted by a simple liquid pump and the whole control of the supply of controlling liquid and discharge of separated heavy liquid and/or control liquid can be performed by means of a so-called constant pressure valve, preferably, however, two constant pressure valves. If a container is needed for a buffer amount of control liquid, such a container may be free of pressure and common to several centrifugal separators. If desired, control liquid may be reused in that at least part of the liquid leaving the rotor through said discharge conduit is conducted to a common container of this kind.

Said control liquid may be of the same kind as the separated heavy liquid, i.e. usually water. Further, depending upon which components are included in the control equipment, the predetermined radial supply level for the interface layer in the separating chamber between separated light liquid and separated heavy liquid may be the same as or somewhat differing from the predetermined radial discharge level for this interface layer. Preferably, a certain radial movement of the interface layer is admitted, since a more stable control of the supply and discharge of liquid is thereby facilitated.

The supply of control liquid to the rotor may be made to any suitable part of the rotor. However, in a preferred embodiment of the invention the previously mentioned space in the rotor is used both for the supply of control liquid to the rotor and for discharge of separated heavy liquid from the rotor. Separate members may be arranged for the supply of liquid to and the discharge of liquid from this space, but preferably said liquid transferring member for introducing control liquid into the rotor may be used also for discharge of liquid from the rotor, the liquid transferring member preferably forming a channel, through which said supply conduit as well as said discharge conduit communicate with said space in the rotor. The liquid transferring member then may include a so-called paring member or, for instance, include at least two stationary circular discs, which are arranged coaxially with the rotor and axially spaced from each other in said space. Liquid may be supplied and discharged through a central opening in one of the discs, the space between the discs communicating with said space in the rotor at the periphery of the discs. A liquid transferring member of this kind, used merely for discharge of a liquid from a centrifugal rotor, is described in SE 76 670 (from the year 1930).

A liquid transferring member of this kind may be used in a rotor of a so-called open type, i.e. a rotor in which a free liquid surface is maintained in said space. However, the invention can be used also in a so-called hermetically closed rotor, i.e. a rotor in which a space of said kind is kept completely filled with liquid during the operation of the rotor and said liquid transferring member is constituted merely by a central part of the rotor or by a stationary member adapted to seal against a central part of the rotor.

In a particular embodiment of the invention said discharge device in connection with a rotor of the so-called open type may include a discharge member, which is arranged radially movable in said space in the rotor, so that the position of a free liquid surface in said space may be chosen and may be adjusted according to need, e.g. with regard to the relevant density of the separated liquids. Thus, the radially movable discharge member may be constituted for instance by a paring member of the kind known from WO 97/27946. By means of a discharge member of this kind a varying excess of separated heavy liquid in the rotor may be discharged and the liquid surface in said space in the rotor may be prevented from moving radially inwardly from a predetermined radial level.

If a similar or the same liquid transferring member is used for supply of control liquid to said space, the liquid transferring member can be allowed to move radially during a separating operation and to follow possible movements of the liquid surface therein radially outside said predetermined level. Then, the supply device for supply of control liquid to the rotor may be formed such that control liquid is supplied to the rotor as soon as the liquid transferring member tends to move radially outwardly from the predetermined level. Possibly, the supply of control liquid to the rotor may take place through a supply member separate from a radially movable liquid discharge member. If so, the latter could be used as a floater, which is coupled in one way or another to the supply device and adapted, in response to its radial movement or its radial position, to control the supply of control liquid in a way such that the free liquid surface is maintained at the predetermined radial level. As mentioned, however, one and the same liquid transferring member is preferably used for both supply and discharge of liquid to and from, respectively, the rotor.

For avoiding that the liquid surface in said space in the rotor moves radially inside the predetermined level, the rotor may have an overflow outlet in said space. Liquid flowing over this overflow outlet may either be allowed to leave the rotor directly or be caught in an outlet part of the space and be conducted out of the rotor through a non-rotating discharge member, e.g. a paring disc.

In case an overflow outlet of the kind just mentioned is not used but the liquid is conducted out of said space in the rotor directly through a non-rotating discharge member, the previously mentioned discharge conduit with which the discharge member is connected preferably contains an outlet valve, which is controllable in a way such that it maintains a desired predetermined liquid pressure in the discharge conduit upstream of the outlet valve. Valves of this kind, which are previously well known under the name constant pressure valves, are adapted to let through a liquid flow of a varying magnitude while maintaining a constant pressure upstream of the valve. A valve of this kind gives the same result in said space in the rotor as an overflow outlet arranged therein for liquid flowing out from the rotor separating chamber, i.e. it prevents a free liquid surface in the space in the rotor from moving radially inside a certain predetermined radial level.

Correspondingly, said supply device for the supply of control liquid may be provided with means which automatically supply control liquid to the rotor only in an amount per unit of time such that the free liquid surface in the space in the rotor does not move radially outwardly from the predetermined radial level therein. Even in this case a so-called constant pressure valve may be used, which is then situated in said supply conduit and adapted, independently of the magnitude of a liquid flow admitted therethrough, to keep the liquid pressure downstream of the valve at a desired predetermined value. A precondition for this is that the supplied control liquid in the supply conduit downstream of the valve has hydraulic contact through the previously mentioned liquid transferring member with the liquid rotating with the rotor in said space therein. If so, namely, the value of the liquid pressure in the supply conduit constitutes a measurement of the radial level of the free liquid surface in this space. A relatively high liquid pressure in the supply conduit, thus, corresponds to a relatively small radial distance between the free liquid surface and the rotational axis of the rotor, whereas a relatively low liquid pressure in the supply conduit corresponds to a relatively large distance of this kind. If the liquid pressure in the supply conduit would exceed a desired or a predetermined value, the valve closes completely for through flow.

Even in connection with a so-called hermetically closed rotor constant pressure valves of the above described kind may be used. Even in a case like this the magnitude of the liquid pressure in the supply conduit and in the discharge conduit becomes a measurement of the radial level of the interface having been formed in the separating chamber of the rotor between separated heavy liquid and separated light liquid.

In a preferred embodiment of the invention a liquid transferring member in the one flow direction communicates with said space in the rotor and in the other flow direction communicates with said supply conduit as well as said discharge conduit. In the supply conduit there is situated an inlet valve in the form of a first constant pressure valve, adapted to let through a variable amount of pressurized control liquid from the previously mentioned pressure source to the liquid transferring member only in an amount per unit of time such that the liquid pressure in the supply conduit downstream of the inlet valve does not drop below a predetermined first value. Further, there is placed in the discharge conduit an outlet valve in the form of a second constant pressure valve, which is adapted to let through a variable amount of liquid in a direction away from the rotor only in an amount per unit of time such that the liquid pressure in the discharge conduit upstream of the outlet valve does not rise above a predetermined second value. The predetermined first value may coincide with the predetermined second value, but preferably a certain difference exists between the values, whereby a better co-operation is obtained between the control function performed by the inlet valve and the control function performed by the outlet valve.

If the predetermined first value, i.e. the pressure value for the opening of the inlet valve, is somewhat lower than the predetermined second value, i.e. the pressure value for the opening of the outlet valve, the free liquid surface in said space in the rotor is allowed to move within certain limits without any liquid flow at all coming up through said liquid transferring member. If, instead, the pressure value for the opening of the inlet valve is somewhat higher than the pressure value for the opening of the outlet valve, a certain flow of liquid will always take place from the supply conduit to the discharge conduit.

If a pressure source can be provided, which delivers control liquid having exactly a desired pressure independent of the magnitude of a supplied flow of control liquid, it would be required in the control equipment according to the invention only one single constant pressure valve, i.e. the one in the discharge conduit. If so, this would be able to perform the function to prevent a liquid flow in the undesired direction, i.e. from the rotor back to said pressure source through the supply conduit.

In addition to the control equipment described above the invention also relates to the general method, in connection with a centrifugal separator of the initially described kind, of removing liquid from said space in the rotor a different way than through said supply device, when the rotor is charged with an excess amount of heavy liquid.

BRIEF DESCRIPTION OF THE DRAWINGS

The invention is described in more detail in the following with reference to the accompanying drawing, in which FIG. 1 schematically shows a longitudinal section through a rotor forming part of a centrifugal separator, in which a control method and a control equipment according to the invention may be used, FIGS. 2–5 schematically illustrate different embodiments of a control equipment according to the invention and FIG. 6 schematically illustrates a plant comprising three centrifugal separators which are coupled in parallel and which are provided each with its own control equipment according to the invention.

DETAILED DESCRIPTION OF THE PREFERRED EMBODIMENTS

Figure 1:
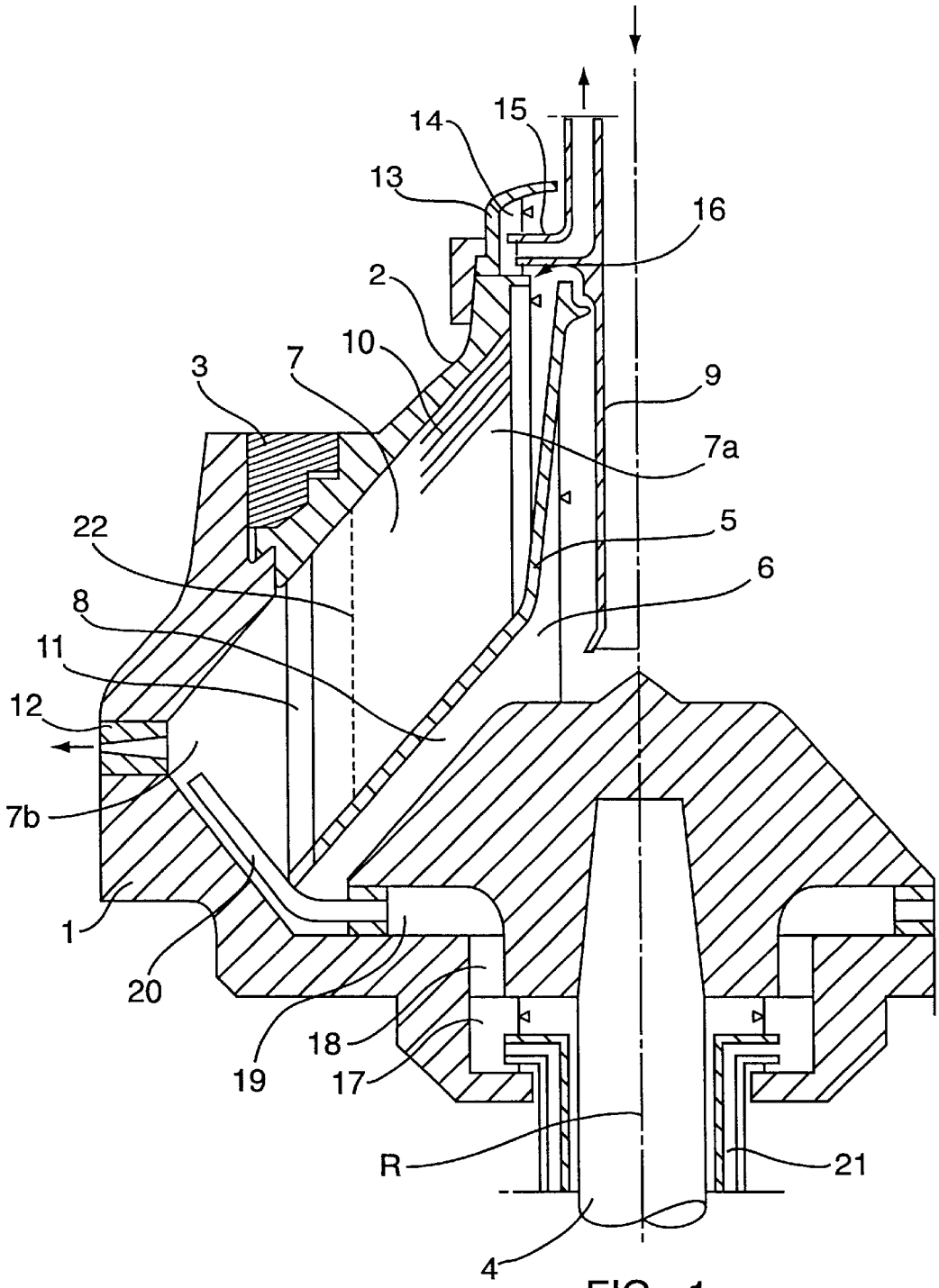

The centrifugal rotor in FIG. 1 includes a rotor body having a lower part 1 and an upper part 2, which parts are connected with each other by means of a lock ring 3. The rotor is supported at the top of a vertical drive shaft 4, connected with the lower rotor body part 1, and is rotatable around a rotational axis R.

Within the rotor there is a so-called distributor 5, which divides the rotor interior into a central inlet chamber 6 and an annular separating chamber 7 extending around the distributor. The distributor 5 rests on the central portion of the lower rotor body part 1 through radially and axially extending wings (not shown), which are distributed around the rotational axis R of the rotor. Through channels 8, delimited between said wings, the inlet chamber 6 communicates with the separating chamber 7. A stationary inlet pipe 9 extends from above axially into the rotor and opens in the inlet chamber 6.

Within the separating chamber 7 there is arranged a conventional set of conical separation discs 10, which are kept axially where they should be between the upper part 2 of the rotor body and the lower part of the distributor 5. Each separation disc 10, like the lower part of the distributor 5, has at its outer periphery a number of recesses distributed around the rotational axis R. Axially aligned recesses of this kind are illustrated at 11.

At the radially outermost part of the separating chamber 7 the lower rotor body part 1 carries several nozzles 12 distributed around the rotational axis R of the rotor. Each nozzle 12 has a through channel, through which liquid and finely divided solids may be thrown out from the separating chamber 7.

The upper rotor part 2 carries a central annular cap 13, which on its inside delimits an annular outlet chamber 14 open radially inwardly towards the rotational axis of the rotor. On its outside the stationary inlet pipe 9 supports an outlet member 15 in the form of a so-called paring disc, which extends radially outwardly into the outlet chamber 14.

A radially inner part 7*a* of the separating chamber 7 communicates with the outlet chamber 14 through an overflow outlet 16 formed by an annular flange, which is supported by the upper rotor body part 2 on its inside. The overflow outlet 16 is not necessary for the function of the rotor and could, if desired, be dispensed with. Alternatively, the outlet member 15 could be dispensed with, liquid flowing out from the separating chamber 7 then leaving the rotor directly.

In the lower part 1 of the rotor body there is delimited an annular space 17, which is open radially inwardly towards the rotor rotational axis R. The space 17 through channels 18 and 19 and several pipes 20 distributed around the rotational axis R communicates with a radially outer part 7*b* of the separating chamber 7.

A stationary liquid transferring member 21 extends into the space 17 and is adapted either to conduct liquid into the space 17 or conduct liquid out therefrom.

A vertical dotted line 22 in the separating chamber 7 indicates a certain radial level therein.

The centrifugal rotor in FIG. 1 is suitable for treatment of a mixture of oil and water and solids suspended therein. The mixture is to be supplied to the rotor through the inlet pipe 9 and be forwarded from the inlet chamber 6 through the channels 8 to the separating chamber 7. Through distributing channels formed by the recesses 11 in the separating discs the mixture is distributed between the various interspaces between the separating discs 10, in which the different mixture components are separated from each other. Thus, separated oil flows radially inwardly and further out of the rotor through the outlet chamber 14 and the outlet member 15, whereas separated solids and water leave the rotor through the nozzles 12.

If the amounts of water and oil, which leave the rotor through the nozzles 12 and the outlet member 15, respectively, equal the amounts of water and oil forming a part of the mixture supplied to the rotor, an equilibrium will come up in which an interface layer between separated oil and separated water is formed and maintained at the radial level 22 in the separating chamber 7. Then no liquid flows out of the rotor or into the rotor through the liquid transferring member 21. In a situation of equilibrium of the described kind it is presumed that free liquid surfaces are formed in the various chambers and spaces of the rotor at the radial levels which are indicated in FIG. 1 by small triangles. It is further presumed that separated solids leave the rotor through the nozzles 12 without blocking them for outflowing separated water.

Depending upon wear of the nozzles 12 and/or variations of the amount of water and oil in the mixture supplied to the rotor, it is impossible in practice, however, without use of a special control equipment to maintain said interface layer between oil and water in the separating chamber 7 at said radial level 22. A control equipment of this kind is connected to the liquid transferring member 21 and is adapted through this either to supply a variable amount of control liquid to the rotor in the form of for instance water, if said interface layer in the rotor tends to move radially outwardly from the level 22, or remove a variable amount of water from the rotor if the interface layer tends to move radially inwardly from the level 22.

With reference to the FIGS. 2–5 the following describes different embodiments of a control equipment of this kind according to the present invention for maintaining an interface layer between oil and water at the radial level 22 in the separating chamber 7.

Figure 2:
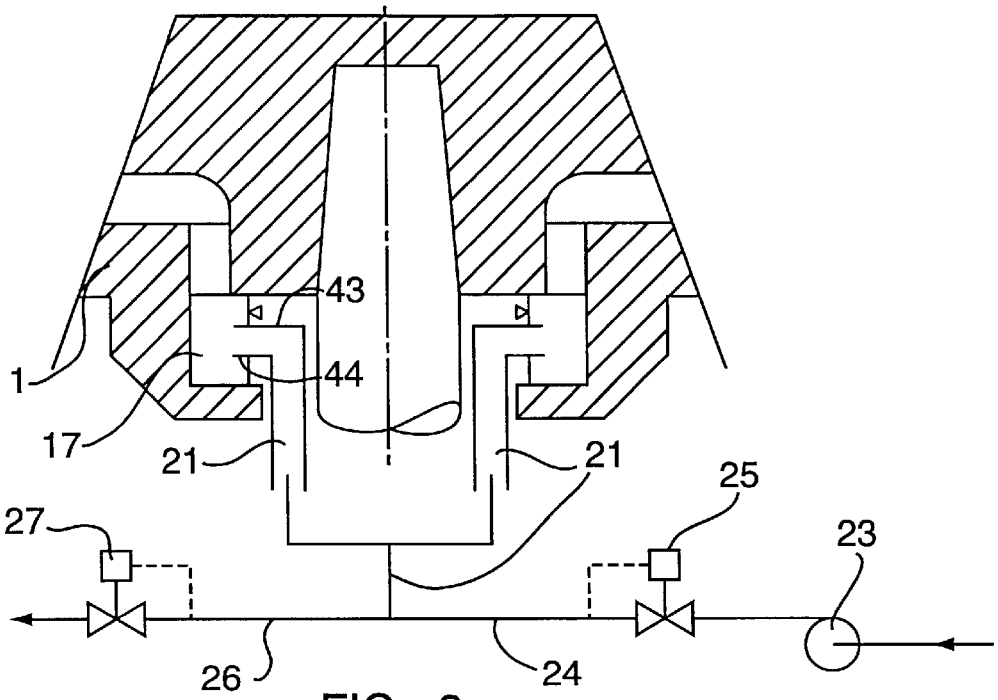

FIG. 2 schematically shows a control liquid supply device, which includes a pressure source in the form of a pump 23 and a supply conduit 24 connected at its one end to the outlet of the pump 23 and at another end to the liquid transferring member 21 having at least two substantially circular discs 43 and 44. The discs 43 and 44 are spaced apart relative to one another and are arranged in and approximately coaxial with the rotor. The discs 43 and 44 define a space therebetween which communicates with a surrounding space defined by the rotor at the periphery of the discs. Arranged in the supply conduit 24 is a constant pressure valve 25 which is adapted to be adjusted to let through pressurized liquid, delivered by the pump 23, only as long as the pressure in the conduit 24 downstream of the valve 25 is lower than a predetermined set value. If the pressure is higher than this predetermined value, the valve is closed. The valve 25 is preferably adapted to let through a variable amount of liquid per unit of time, the amount per unit of time depending upon the magnitude of the pressure variations coming up in the conduit 24.

The control equipment in FIG. 2 further includes a liquid discharge device, which has a discharge conduit 26 and a constant pressure valve 27 arranged therein. The discharge conduit 26, like the supply conduit 24, is connected to the liquid transferring member 21. The valve 27 is adapted to be adjusted for letting through pressurized liquid as long as the pressure in the discharge conduit 26 upstream of the valve 27 is higher than a predetermined set value. If the pressure is lower than this predetermined value, the valve is closed. Like the valve 25 the valve 27 is preferably adapted to let through a variable amount of liquid per unit of time. The valves 25 and 27 may be connected to a control unit (not shown), by means of which the valves may be adjusted for automatically opening at desired variable pressure values in the conduits 24 and 26 between the valves.

The liquid transferring member 21 within the scope of the invention may be of different kinds. If it is stationary, i.e. non-rotating, as illustrated in the FIGS. 1 and 2, it may preferably include an annular disc surrounding the rotor rotational axis R and extending into the space 17. It may form one or more radially extending channels, or form one or more annular channels extending around the rotational axis R (see SE 76 670). In both cases the channels open in the liquid, which is present in the space 17. In a channel of one of these kinds there will come up upon rotation of the rotor a liquid pressure, the magnitude of which is dependent on the position of the free liquid surface of the liquid body rotating together with the rotor in the space 17. Said position of the liquid surface in the space 17 is in turn influenced by occurring movements of the radial position of the interface layer in the separation chamber 7 between separated oil and separated water. Thus, if the interface layer in the separating chamber 7 moves radially outwardly, also the free liquid surface in the space 17 moves radially outwardly, the pressure in the supply conduit 24 and the discharge conduit 26 dropping. Upon movement of the interface layer radially inwardly the pressure increases in the conduits 24 and 26 between the valves 25 and 27.

If the pressure in the supply conduit 24 and the discharge conduit 26 tends to drop below a predetermined first value, which corresponds to a so-called supply level for the interface layer between oil and water in the separating chamber 7 somewhat radially outside the level 22, the valve 25 is opened, so that water is pumped by means of the pump 23 into the space 17 and further through the channels 18 and 19 and the pipes 20 to the separating chamber 7. The valve 25 is opened more or less dependent upon how low the pressure in the conduit 24 drops, the water then being pumped in an amount per unit of time such that the interface layer between oil and water in the separating chamber is maintained radially inside the above said supply level. It may occur that the valve 25 remains open during a considerable period of time, for instance if the reason for the pressure drop in the conduit 24 is that one or more of the nozzles 12 have been worn and are causing an undesired large outflow of water.

If instead the pressure in the supply conduit 24 and the discharge conduit 26 tends to rise above a predetermined second value, which corresponds to a so-called discharge level for the interface layer between oil and water in the separating chamber 7 somewhat radially inside the level 22, the valve 27 is opened, so that water is allowed to leave the space 17 through the liquid transferring member 21 and the discharge conduit 26. The valve 27 is opened more or less dependent upon how much the pressure in the conduit 26 rises, water then being let out through the valve 27 in an amount per unit of time such that the interface layer between oil and water in the separating chamber is maintained radially outside the above said discharge level. Even the valve 27 may be more or less open during a considerable period of time.

As made clear, a certain radial movement is allowed of the said interface layer between a so-called supply level and a so-called discharge level at each sides of the radial level 22. It would be possible to choose one and the same pressure for the two said pressure values, at which the valves 25 and 27 should open for maintaining the interface layer in the separating chamber 7 exactly at the radial level 22. However, this would make it difficult to obtain a stable control of the opening and closing movements of the two valves.

An alternative possibility for avoiding instability of the control of the two valves 25 and 27 is to allow the valves simultaneously to be somewhat open and let through a small amount of liquid as long as the interface layer in the separating chamber 7 is situated between said supply level and said discharge level. In this case, thus, the valve 27 should be adapted to begin to open at a pressure in the conduits 24 and 26 somewhat lower than the pressure, at which the valve 25 should start to open. If the pressure in the conduits 24, 26 tends to rise, the valve 27 will then open further, whereas the valve 25 is closed, and if the pressure tends to drop, the valve 25 will instead open further, whereas the valve 27 will close.

Figure 3:
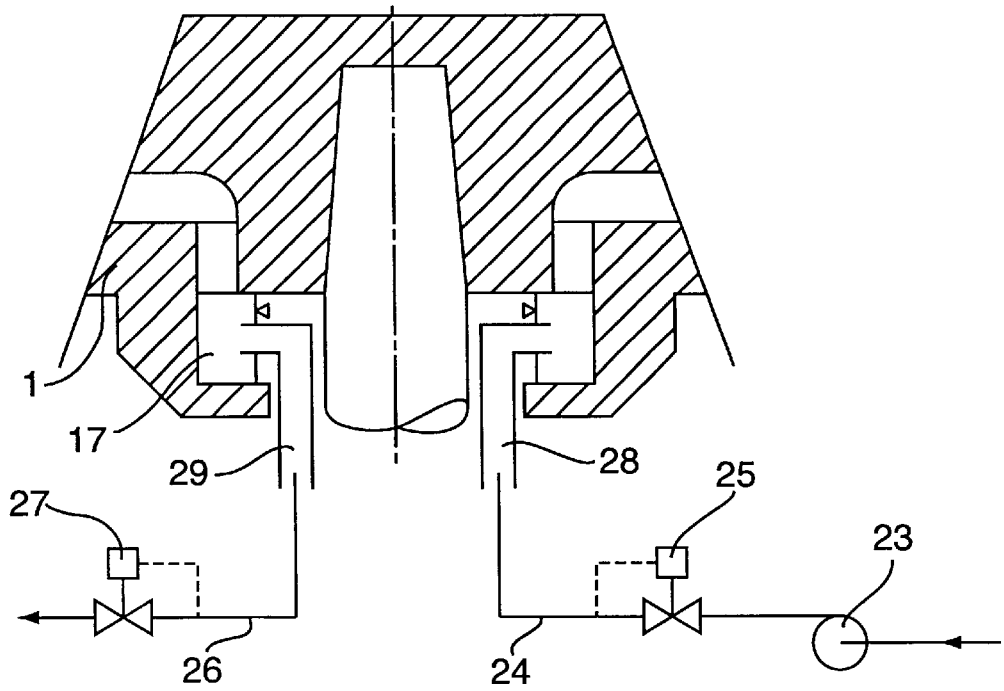

FIG. 3 illustrates another embodiment of the control equipment according to the invention. In this case the supply conduit 24 is connected with a first liquid transferring member 28 for supply of liquid to the space 17 of the rotor, whereas the discharge conduit 26 is connected with a second liquid transferring member 29 for discharge of liquid from the space 17. If desired, the liquid transferring members 28 and 29 may be formed in a single piece but have separate channels communicating with the supply conduit 24 and the discharge conduit 26, respectively.

The control equipment according to FIG. 3 operates principally in the same way as the one according to FIG. 2. The only difference is that in FIG. 3 the supply conduit 24 communicates with the discharge conduit 26 indirectly through the liquid body in the rotor space 17 and not directly as in FIG. 2.

Figure 4:
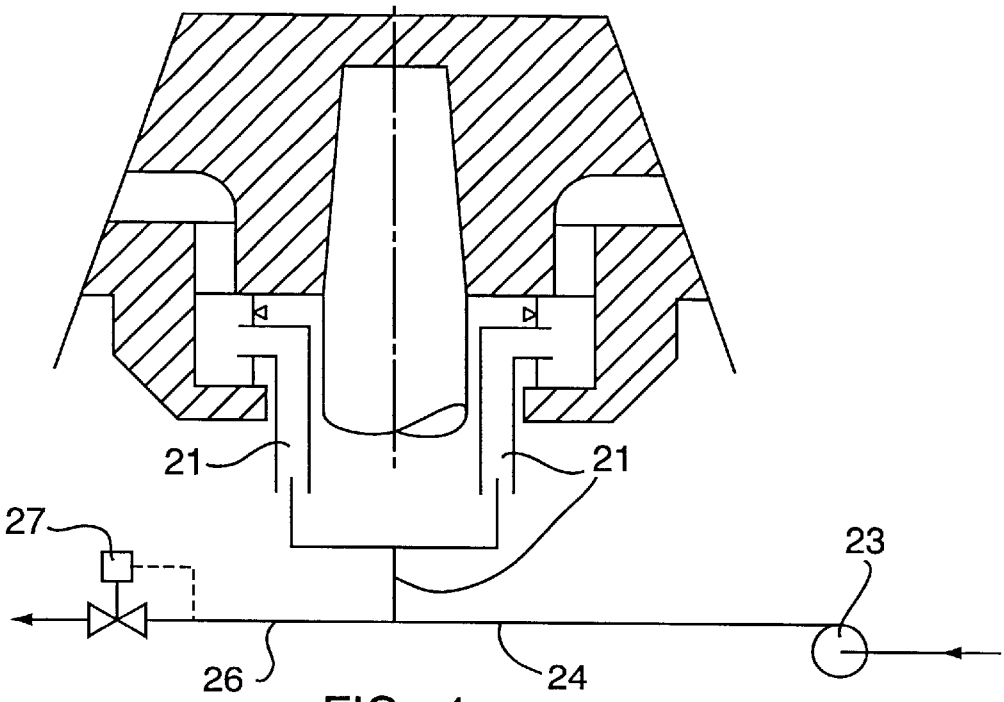

FIG. 4 illustrates a third embodiment of the control equipment according to the invention, which distinguishes from the embodiment according to FIG. 1 in that no constant pressure valve is arranged in the supply conduit 24. Instead, it is presumed in this case that the chosen pressure source 23 in itself is of a kind such that it can deliver a variable amount of liquid to the supply conduit 24, so that a predetermined pressure is maintained therein, and if the pressure in the supply conduit tends to rise above the predetermined pressure no liquid is delivered any longer. If needed, a non-return valve may be arranged in the supply conduit 24 for preventing an undesired liquid flow from the rotor space 17 to the pressure source 23. If the pressure source 23 is constituted by a rotational pump, the capacity thereof may be controllable by means of a device sensing the pressure in the supply conduit 24 or the pressure at a certain radial level in the liquid body in the space 17. Alternatively, a device may be arranged for sensing the radial position of the free liquid surface in the space 17. In all the cases a sensing operation of this kind has for its object to sense the radial position of the interface layer formed in the separating chamber between oil and water. Therefore, a device could instead be arranged for direct sensing of the radial position of said interface layer.

Any suitable device can be used for sensing of the position of said interface layer for the control of the pressure source 23 or for instance a valve in the supply conduit 24 in a way such that the interface layer is not displaced radially outside a desired level in the separating chamber 7.

In a corresponding way any suitable device for sensing of the position of said interface layer may be used for controlling for instance a valve in the discharge conduit 26 in a way such that the interface layer is not discharged radially inside a desired level in the separating chamber 7.

What has been described above with reference to FIG. 4 is applicable even if—like in FIG. 3—the supply conduit 24 communicates with the discharge conduit 26 only indirectly through the liquid body in the rotor space 17.

Figure 5:
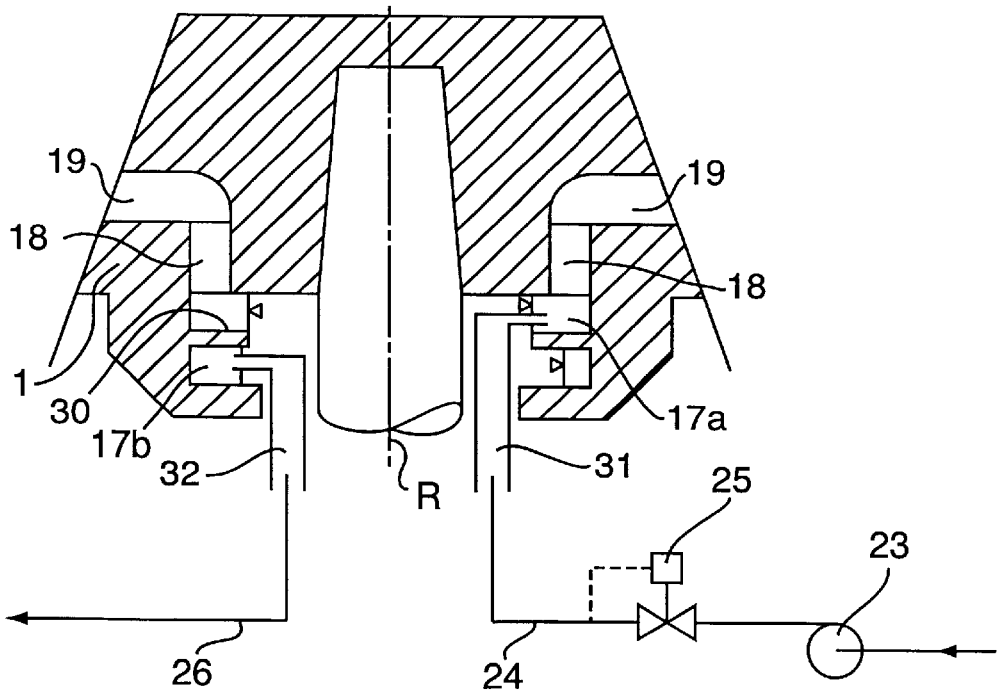

FIG. 5 illustrates a fourth embodiment of the control equipment according to the invention. In this case the previously described space in the rotor is divided by means of an annular partition 30 in two chambers 17*a* and 17*b*. The supply conduit 24, as in the FIGS. 2 and 3, is provided with a constant pressure valve 25 and is connected with a liquid transferring member 31, which extends into the chamber 17*a*. The chamber 17*a* communicates with the rotor separating chamber 7 through the previously described channels 18 and 19 and the pipes 20 (see FIG. 1). The constant pressure valve 25 is set in a way such that upon need it lets through pressurized water, which is delivered by the pump 23, only to an amount per unit of time such that is required for avoiding that the interface layer between oil and water in the separating chamber 7 moves radially outwardly from said predetermined supply level. This supply level for the interface layer corresponds to the radial position of the free liquid surface in the chamber 17*a*, which is shown to the right of the rotor rotational axis R in FIG. 5. If this free liquid surface in the chamber 17*a* tends to move radially outwardly, the valve 25 thus opens so that further water is pumped into the chamber 17*a*. If the liquid surface in the chamber 17*a* tends to move radially inside the radial position just mentioned, the valve 25 closes.

If the liquid surface in the chamber 17*a* moves further radially inwardly, the radially inner edge of the partition 30 will eventually serve as an overflow outlet for water then flowing over into the lower chamber 17*b*. The free liquid surface in the chamber 17*a* will then be situated in a position as shown to the left of the rotor rotational axis R in FIG. 5.

Water flowing over to the chamber 17*b* is conducted out thereof by means of a liquid transferring member 32, which is connected with the discharge conduit 26.

Whereas the liquid transferring member 31 preferably has one or more radial channels for supply of water to the chamber 17*a*, the liquid transferring member 32 is preferably formed as an ordinary paring member, e.g. a paring disc, for fastest possible pumping of water out of the chamber 17*b*.

In the embodiment according to FIG. 5 no control valve is needed in the discharge conduit 26, since the partition 30 serves as an overflow outlet from the chamber 17*a* and the free liquid surface in the chamber 17*a*, thus, remains at the radial level of the overflow outlet as long as an excess amount of water leaves the rotor separating chamber 7 through the chamber 17*a*.

FIG. 5 illustrates the two different positions for the free liquid surface in the chamber 17*b*. To the left of the rotor rotational axis R the position of the liquid surface is shown when liquid is pumped out of the rotor and to the right of the rotational axis R the position of the liquid surface is shown when no liquid is pumped out of the rotor.

Upon use of the embodiment of the invention shown in FIG. 5 it may be suitable to avoid a radially fixed overflow outlet 16 in the rotor outlet for separated oil (see FIG. 1). Instead, in this case the outlet member 15 is preferably used in a known way for setting of a desired level for the free liquid surface in the outlet chamber 14 and thereby in the separating chamber 7. Then, if desired, a radially movable and adjustable outlet member may be used, e.g. of the kind to be seen from WO 97/27946.

A radially movable and adjustable outlet member of this kind can also be used in the rotor space 17 at the embodiments of the invention according to the FIGS. 2–4 for fulfilling the functions of the liquid transferring member 21 or 28 and/or the liquid transferring member 29.

The possibility of radial adjustment of the free liquid surface in the outlet chamber 14 and/or in the space 17 to a desired level, e.g. by means of a radially movable outlet member, may be desirable for adjustment of the position of the previously mentioned interface layer in the separating chamber upon occurring density changes of one or both of the liquid components separated in the rotor.

Figure 6:
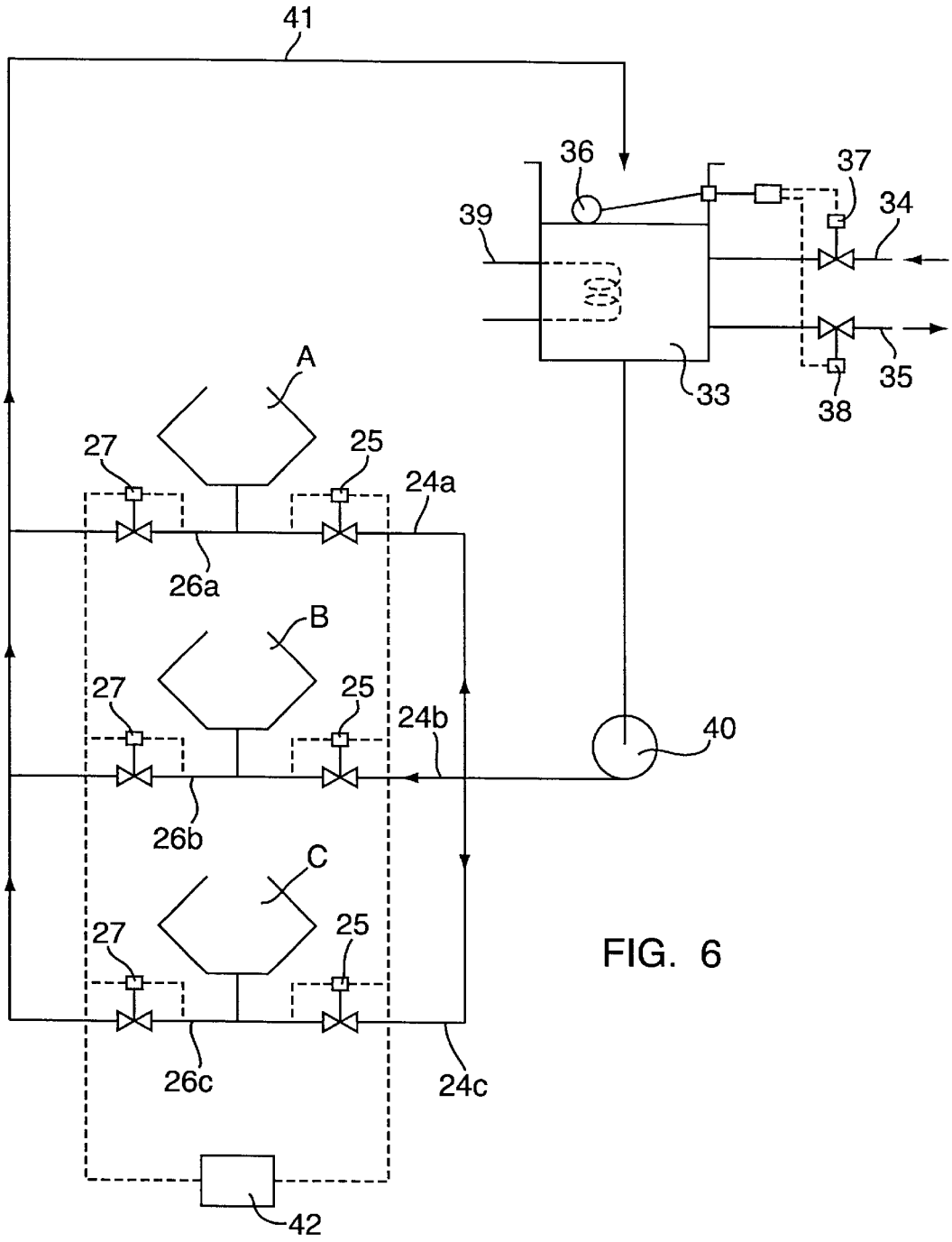

FIG. 6 illustrates schematically a plant including three centrifugal separators A, B and C, coupled in parallel, each being controllable by means of a control equipment according to the invention.

In a container 33 water is maintained in a desired amount and at a desired temperature. For this there is an inlet conduit 34, an outlet conduit 35, a floater 36 and valves 37 and 38 in the inlet and outlet conduits 34 and 35, respectively, controlled by the floater. A heating device is shown schematically at 39.

A pump 40 is arranged for pumping water upon need from the container 33 to each one of the three supply conduits 24*a*, 24*b* and 24*c*, each one corresponding to the supply conduit 24 in the FIGS. 2–5. Each control equipment also includes a discharge conduit 26*a*, 26*b* or 26*c*, corresponding to the discharge conduit 26 in the FIGS. 2–5, and constant pressure valves 25 and 27 in the different supply and discharge conduits. The discharge conduits 26*a–c* open into a common conduit 41, which may conduct excess water from the discharge conduits 26*a–c* to the container 33.

A control unit 42 is connected with all of the constant pressure valves 25 and 27 for adjustment thereof, so that they open and close at predetermined pressures in the conduits 24*a–c* and 26*a–c*. There could also be connected to this control unit various sensing means adapted to sense various parameters, such as temperature, pressure, viscosity etc. of liquids in different parts of the process plant. In response to changed values of such parameters the control unit 42 may be adapted to change the setting of said valves or the alternative devices which may be present for influencing the liquid flows in the conduits 24*a–c* and 26*a–c*.

The control equipments for the centrifugal separators A, B and C are shown in accordance with the embodiment of the invention seen in FIG. 2. However, they may be constructed according to any one of the embodiments in the FIGS. 2–5.

The plant in FIG. 6 may be used for treatment of a mixture containing oil, water and sand. Such treatment takes place in connection with processes for recovery of oil from oil sands and is usually performed by means of nozzle separators of the kind shown in FIG. 1. Each one of the centrifugal separators A, B and C in FIG. 6 is assumed to be a nozzle centrifuge of this kind.

In order to avoid that oil accompanies sand particles out through the nozzles 12, a certain amount of water must be maintained during the whole separating operation in the radially outermost part 7*b* of the centrifugal rotor separating chamber. If the mixture of oil, water and sand supplied to the centrifugal rotor does not have a sufficient content of water, further water has to be added during ongoing separation. Such supply should be made exactly according to need, so that the interface layer formed between separated oil and separated water in the centrifugal rotor separating chamber is maintained at a desired radial level. Hereby, the best possible separating result is obtained. It is also desirable that the temperature of the supplied additional water is the right one, i.e. the one having been chosen for the obtainment of a best possible separating result in the separating chamber. For this reason the heating device 39 is arranged in connection to the container 33 for water having to be supplied to the centrifugal separators A–C during operation.

During certain stages of the separating operation it may occur that the liquid mixture supplied to the centrifugal separators contains more water than can leave the centrifugal separators through the nozzles 12. Such excess water leaves through the spaces 17 in the centrifugal rotors (see FIG. 1) and is conducted out thereof through the discharge conduits 26*a–c* and the common conduit 41 to the container 33.

When a control equipment according to the invention is used in connection with nozzle separators of the kind here described, it may be advantageous to dimension the relevant nozzles in a way such that all the water that is separated from the liquid mixture supplied to the centrifugal rotors may leave through the nozzles, a small amount of additional water being constantly introduced into said spaces 17 in the centrifugal rotors to maintain the free liquid surfaces in these spaces at an unchanged radial level.

Of course, a control equipment according to the invention may be used also in connection with a hermetically closed centrifugal rotor, i.e. a centrifugal rotor in which a space 17 is intended to be completely filled with liquid and communicate with the interior of a stationary liquid transferring member, which seals against the rotatable centrifugal rotor.

What is claimed is:

1. A method of controlling a separating operation during use of a centrifugal separator for separating a light liquid having a relatively low density and a heavy liquid having a relatively high density from a mixture containing the light and heavy liquids, the centrifugal separator including a rotor rotatable around a rotational axis and forming an inlet for said mixture, a separating chamber communicating with said inlet and having a radially inner part and a radially outer part, which parts during a separating operation will contain separated light liquid and separated heavy liquid, respectively, and a space communicating with said radially outer part of the separating chamber such that during a separating operation it will contain separated heavy liquid but not separated light liquid, and control equipment including a supply device for supply to the rotor of a control liquid having a higher density than said light liquid, said supply device having a pressure source for supplying pressurized control liquid and a supply conduit having one end connected to the pressure source for receiving pressurized control liquid and another end connected to a liquid transferring member for introducing pressurized control liquid into the rotor, the method comprising supplying upon need control liquid to the rotor through said supply device only in an amount per unit time required to avoid an interface layer formed in the separating chamber between separated light liquid and separated heavy liquid or control liquid moving radially outwardly from a predetermined radial supply level and, when the rotor is charged with an excess amount of heavy liquid, discharging at least one of said heavy liquid and the said control liquid from said space in the rotor a different way than through said supply device in an amount per unit time required to avoid said interface layer radially moving inwardly from a predetermined radial discharge level.

2. Method according to claim 1, including the further step of introducing control liquid into said space (17) in the rotor.

3. Method according to claim 1, including the step of maintaining a substantially constant liquid pressure in said supply conduit (24), when control liquid is supplied to the rotor therethrough.

4. A method according to claim 1, including the step of discharging at least one of said heavy liquid and said control liquid through a discharge conduit.

5. A method according to claim 4, including the further step of maintaining a substantially constant liquid pressure in said discharge conduit, when at least one of said heavy liquid and said control liquid is discharged from the rotor there through.

6. A method according to claim 4, including the further steps of supplying control liquid to the rotor through said supply conduit only when the pressure in the supply conduit drops below a predetermined first pressure, and discharging separated heavy liquid from the rotor through said discharge conduit only when the pressure in the discharge conduit rises above a predetermined second pressure, which is somewhat higher than said predetermined first pressure.

7. A method according to claim 4, including the further steps of supplying control liquid to the rotor through the supply conduit only when the pressure in the supply conduit drops below a predetermined first value, and discharging separated heavy liquid from the rotor through the discharge conduit only when the pressure in the discharge conduit rises above a predetermined second value, which is somewhat lower than said predetermined first value.

8. A method according to claim 4, including the further step of supplying control liquid to the rotor through said supply conduit from a container, with at least part of the liquid discharged from the rotor through said discharge conduit being conducted to said container.

9. A method according to claim 1, including using a control liquid having approximately the same composition as said separated heavy liquid.

10. A method according to claim 1 including the step of discharging at least one of said heavy liquid and said control liquid from said space in the rotor through an overflow outlet of the rotor.

* * * * *